US005105565A

United States Patent [19]

Barret

[11] Patent Number: 5,105,565

[45] Date of Patent: Apr. 21, 1992

[54] INTERNAL TIGHTENING DEVICE FOR CROSS-COUNTRY SKI BOOT

[75] Inventor: Thierry Barret, Pringy Gare, France

[73] Assignee: Salomon S.A., France

[21] Appl. No.: 578,803

[22] Filed: Sep. 7, 1990

[30] Foreign Application Priority Data

Sep. 7, 1989 [FR] France ..... 89 11937

[51] Int. Cl.[5] ..... A43B 5/04; A43B 5/16

[52] U.S. Cl. ..... 36/117; 128/611; 36/88; 36/91; 36/119; 36/110

[58] Field of Search ..... 36/117, 118, 119, 120, 36/121, 88, 91, 114, 58.5; 128/611

[56] References Cited

U.S. PATENT DOCUMENTS

| | | | |
|---|---|---|---|
| 2,096,160 | 10/1937 | Chambers | 128/611 |
| 4,550,511 | 11/1985 | Gamm | 36/119 X |
| 4,638,578 | 1/1987 | Eiteljorg, II. | 36/120 X |
| 4,811,498 | 3/1989 | Barret | 128/611 X |
| 4,845,864 | 7/1989 | Corliss | 36/131 |
| 4,914,839 | 4/1990 | Paris et al. | 36/120 X |

FOREIGN PATENT DOCUMENTS

| | | | |
|---|---|---|---|
| 1556116 | 1/1969 | France | 36/117 |
| 8904126 | 5/1989 | World Int. Prop. O. | 36/117 |

*Primary Examiner*—Paul T. Sewell
*Assistant Examiner*—BethAnne C. Cicconi
*Attorney, Agent, or Firm*—Pollock, Vande Sande & Priddy

[57] ABSTRACT

A cross-countery ski boot comprising, at least in the area of the instep, an internal tightening device (17,18) for clamping the foot of the user, and a covering and closing upper (10) which envelops the entire foot and covers the internal tightening device. The internal tightening device (17, 18) is so conceived that is presses the uer's foot against the inner side (10*a*) of the boot, this inner side (10*a*) being preferably fitted with a reinforcing piece (11) at least in the area of the internal tightening device (17, 18) against which the foot is pressed.

11 Claims, 3 Drawing Sheets

INTERNAL TIGHTENING DEVICE FOR CROSS-COUNTRY SKI BOOT

FIELD OF THE INVENTION

The present invention relates to a cross-country ski boot, designed more specifically for the performance of the skater's step, or skating, and comprising an internal tightening device for clamping the user's foot and a external covering upper designed to provide impermeability and comfort to the wearer.

BACKGROUND OF THE INVENTION

FR 82.17503 discloses such a boot designed more particularly for competitive use.

In this known boot, the internal tightening device is constituted by two sections enclosing the instep area, which are attached at one end to the mounting insole and are equipped at their free end with supplementary tightening means, constituted, for example, by a lacing system.

Such a construction makes it possible to obtain excellent position maintenance of the foot in the boot and to center the foot on the sole. It is thus particularly well suited to the practice of alternating steps.

Given the development of the new skater's step technique, this tightening device is found to embody certain deficiencies, illustrated in FIG. 1, which illustrates the assembly of a known boot 1 with a ski 2 in the thrusting phase during the performance of the skater's step.

As this figure shows, in this phase the skier exerts on the ski 2 a thrust directed laterally to his path.

Under the effect of this thrust, the foot tends to flatten against the outer edge 1*a* of the boot, such that the thrust force P of the skier is exerted on the outer part of the ski.

The vertical resultant Pv of this thrust force then constitutes, along with the reactive force exerted in the vertical direction R by the snow 4, a moment of force which is especially pronounced because the lever arm d between these two forces is high. This moment of force tends to force the ski flat against the snow, thus impairing the biting action of the edge required for this phase of the movement.

Furthermore, when not in the thrust phase, the foot tends to become recentered in the boot, thus bringing about lateral movements of the foot within the boot which generate friction and the risk of injury.

SUMMARY OF THE INVENTION

The purpose of the present invention is to overcome these difficulties by supplying a cross-country ski of the type described, which prevents the shifting of the skier's foot in the boot when the skater's step is performed.

This goal is achieved in the boot in accordance with the present invention because the internal tightening device is so conceived that it presses the user's foot against the inner side of the boot.

This tightening device counteracts the tendency of the user's foot to move toward the outside of the boot during the thrust phase, thereby guaranteeing that the foot will be positioned to the maximum extent possible in the inner part of the boot during the various phases of the skater's step.

Because of this, the moment of force linked to the thrusting stress and the reactive stress of the snow is less pronounced because of the reduced distance between these two forces, and the output of the thrusting force is thus greater.

According to one embodiment, the inner side of the boot is fitted with a reinforcement piece at least in the area of the internal tightening device against which the foot is pressed, thereby producing an effective wedging action of the foot in the boot.

Advantage is also gained by producing the internal tightening device from two sections, inner and outer respectively, which are attached by one end to the interior of the boot, the inner section being fastened to the upper and the outer section being fastened to the sole of the boot. Each section is equipped at its free end with a tightening system which completes the system of the other section.

By fastening the inner section onto the upper, and not onto the sole of the mounting insole of the boot, as is the case of the outer section, the desired tightening effect is obtained on the inner side of the boot, the inner section being attached at a certain height on the stiffened upper, which thus delimits a stationary tightening surface.

BRIEF DESCRIPTION OF THE DRAWINGS

The invention will be better understood from the following description, provided with reference to the attached drawings illustrating one exemplary embodiment, and in which.

DESCRIPTION OF THE PREFERRED EMBODIMENT

Figure 1:
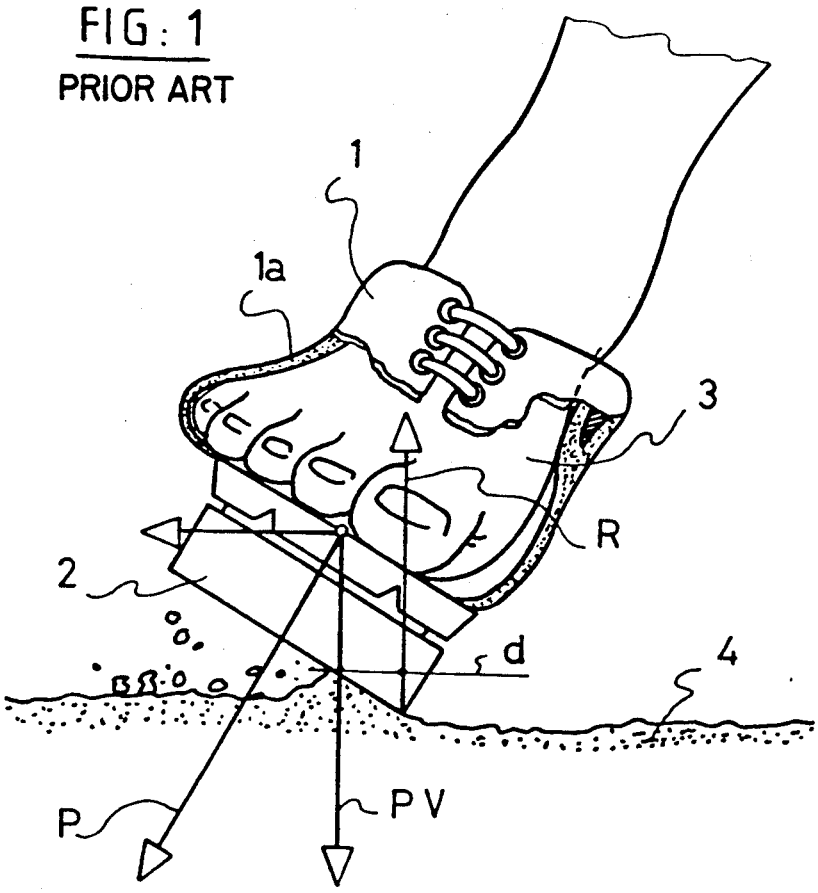
FIG: 1 PRIOR ART
FIG. 1 is a perspective view of a prior art construction.

The cross-country ski boot illustrated in FIGS. 2 to 5 appears externally as a boot incorporating a high upper 10 reinforced in front by a front reinforcing piece 11 and in the rear by a rear reinforcing piece 12, and fitted with an outer sole 13.

This upper 10 comprises, moreover, two sewn half-appliques 14, 15 along the front and rear reinforcing pieces which are attached by a fast-action closing system such as a zipper 16.

These two half-appliques 14, 15 are designed to cover the actual tightening system of the boot or the internal tightening device in order to protect it, especially from cold and snow.

Figure 2:
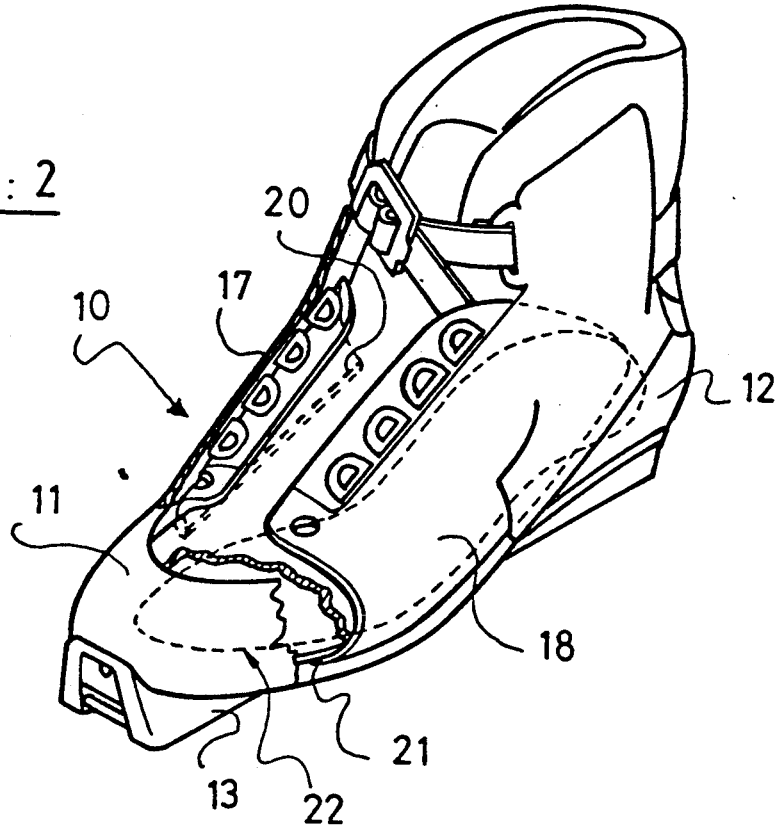
FIG. 2 is a perspective view, partially cut away, of the boot according to the invention.
Figure 3:
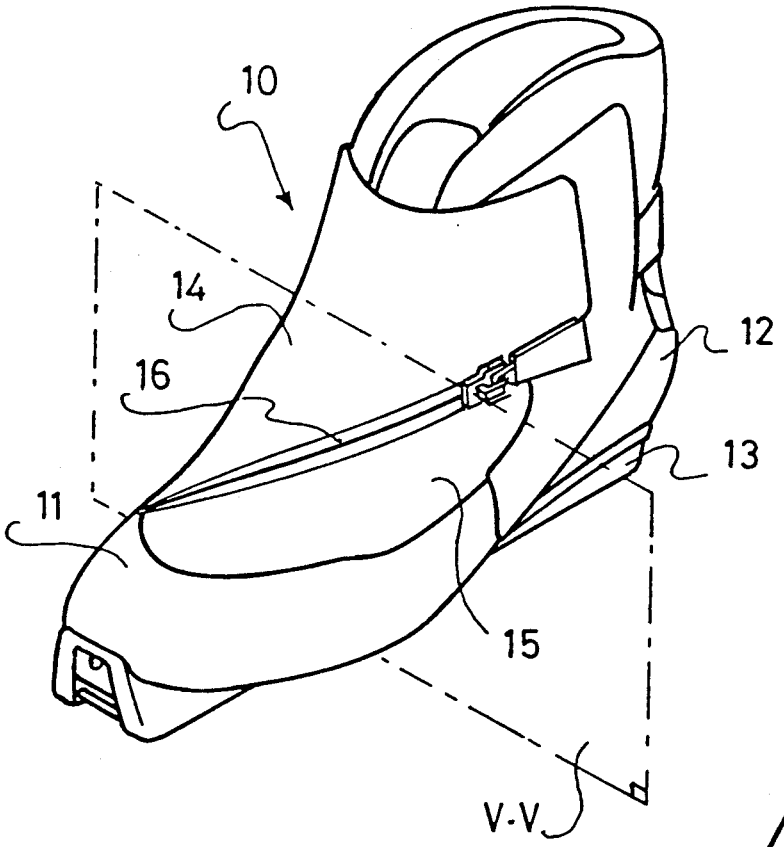
FIG. 3 is a perspective view similar to FIG. 2 but not cut away.
Figure 5:
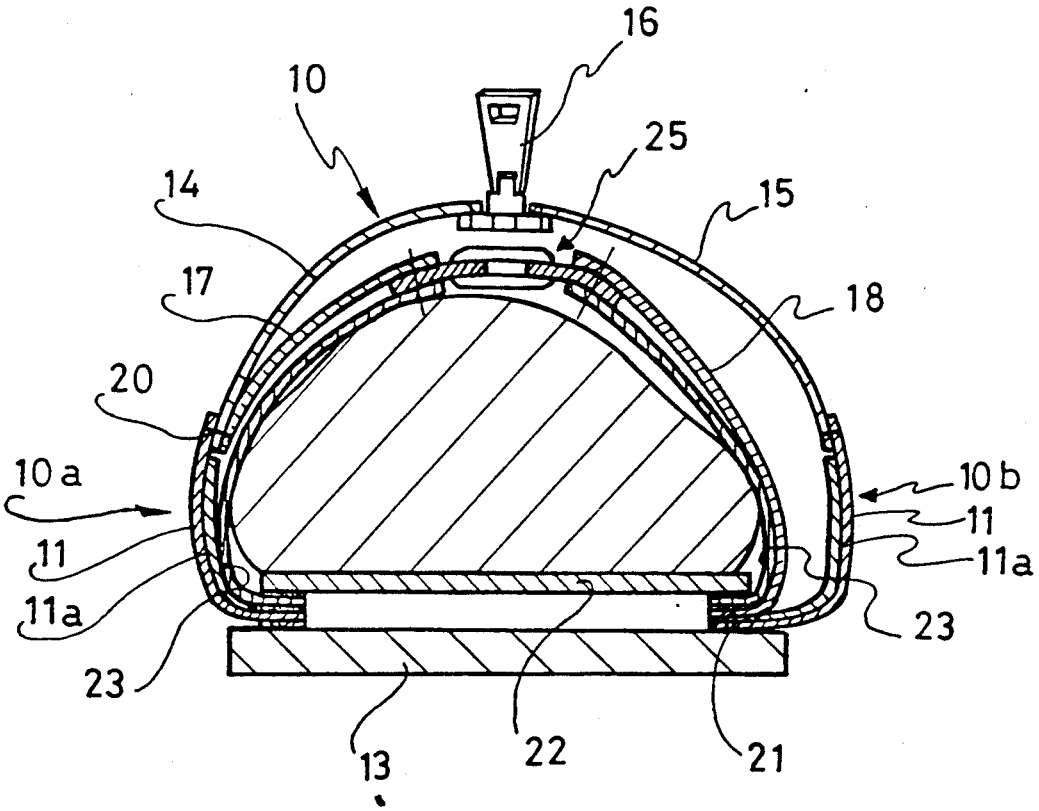
FIG. 5 is a section view through plane V—V of FIG. 3.

The tightening system is shown in more detail in FIGS. 2 and 5 showing the interior of the boot.

This tightening system is constituted by two sections, one inner 17 and the other outer 18, extending over the front part of the foot, particularly in the instep area.

As shown more specifically in FIG. 5, the inner section 17 extends over the inner side 10*a* of the boot and is fastened by its lower edge to the upper 10 by means of stitching 20.

In the case illustrated in which the upper is fitted with a front reinforcing piece 11, the attachment of the inner section 17 to the upper is formed from the same stitching 20 used to fasten the reinforcing piece 11 to the half applique 14. It will be noted that, in the case shown, reinforcing piece 11 is constituted by a piece of leather stiffened internally by a thermoplastic welt 11*a* bonded to the inside and along the entire length of this reinforcing piece 11. Reinforcing piece 11 could also be produced using any other conventional technique.

The inner section 17 is fastened to the upper at the level of the upper end of reinforcing piece 11, and thus at a level of the upper corresponding substantially to the level of the upper end or ridge of the arch, or at a point midway up the height of the upper in this area, the important factor being that this attachment on the inner section 17 not be below a line passing through the upper ridge of the arch.

The outer section !8 extends over the outer side 10*b* of the boot, and is fastened by its lower edge 21 to the mounting insole 22 of the boot.

As illustrated in FIG. 5, the outer section 18 is actually glued between the mounting insole 22 and the outer sole, at the same time as the upper 10 (or its front reinforcing piece 11) and the lining 23 of the boot. It will be noted that the lining 23 on each of sections 17, 18 extends up to the mounting connection, i.e., up to the area in which the mounting insole 22 is fastened to the outer sole 13, so that no stitching (such as 20) comes into direct contact with the foot.

Moreover, the two sections 17 and 18 are fitted at their free ends with a tightening system, such as a lacing system 25.

As shown more especially in FIG. 5, the tightening of the lacing system 25 will bring together the free ends of the two sections 17 and 18, and section 18 will press the foot 6 of the user against the inner edge of the boot.

It will be seen that the provision of a reinforcing piece 11 on the inner side of the boot makes it possible to achieve the ideal immobilization of the foot, since the foot is then pressed against an inflexible part.

Figure 4:
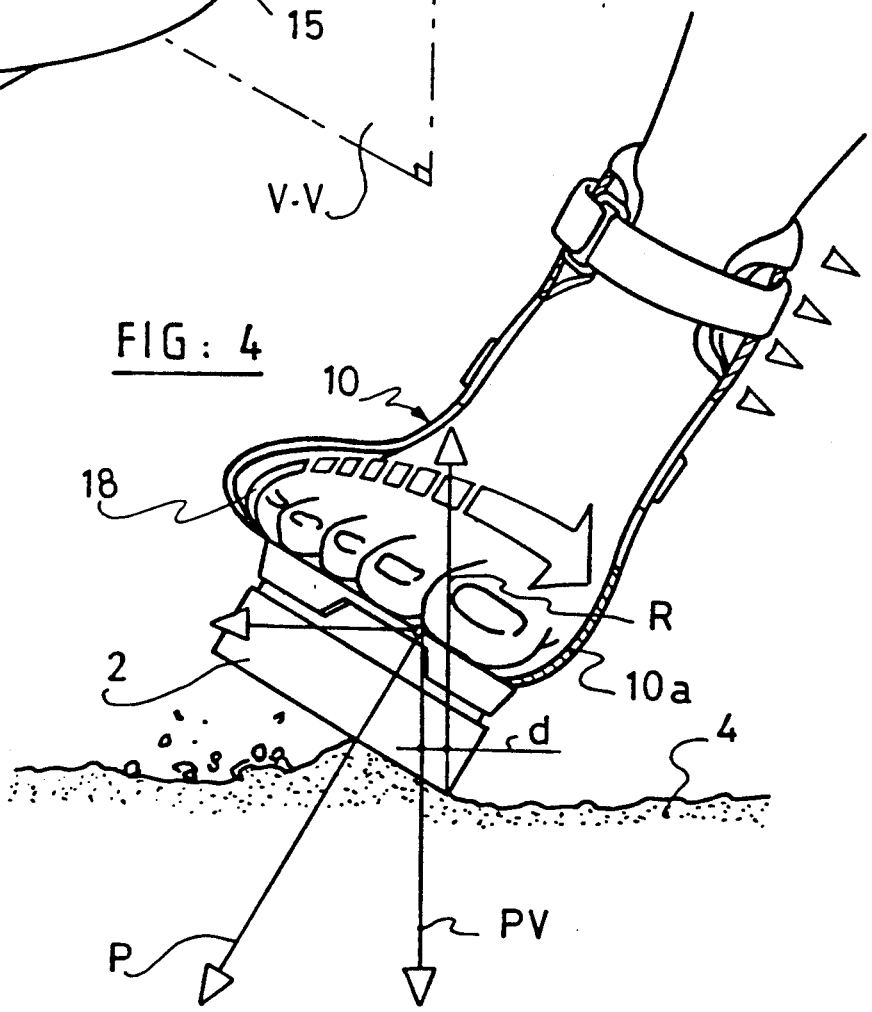
FIG. 4 is a perspective view showing the behavior of the boot according to the invention during the thrusting phase.

As shown in FIG. 4, this immobilization makes it possible to shift the point of exertion of the thrusting force P toward the interior of the ski 2, and consequently to reduce the moment of force tending to bring the ski back flat on the snow 4.

The result is better steering of the ski and less fatigue felt by the skier, and consequently greater efficiency.

What is claimed is:

1. Cross-country ski boot having a medial side, of the type comprising, at least in the arch area, an internal tightening device (17, 18) for immobilizing of a foot of a skier, and a resilient covering and closing upper (10) which envelops the entire foot and covers the internal tightening device, wherein the internal tightening device (17, 18) presses the foot against said medial side (10*a*) of said boot.

2. Cross-country ski boot according to claim 1, wherein said medial side (10*a*) of said boot is fitted with a reinforcing piece (11) at least in the area of said internal tightening device (17, 18) against which the foot is pressed.

3. Cross-country ski boot according to claim 2, wherein said reinforcing piece (11) comprises a thermoplastic weld (11*a*).

4. Cross-country ski boot according to any one of claims 1 to 3, wherein said internal tightening device is constituted by inner (17) and outer (18) sections each fastened by one end of said sections to the interior of the boot, said inner section (17) being fastened to said upper (10) and said outer section (18) being fastened to a sole (22, 13) of said boot, and wherein each of said inner and outer sections (17, 18) is equipped at its free end with a tightening system (25) which completes the system of the other section.

5. Cross-country ski boot according to claim 4, wherein said tightening system (25) is a lacing system.

6. Cross-country ski-boot according to claim 2 or 3, wherein said inner section (17) is fastened to said upper (10) at the level of the upper end of said reinforcing piece (11).

7. Cross-country ski boot according to claim 6, wherein said inner section (17) is made unitary with said upper and with said reinforcing piece (11) by a same stitching (20).

8. Cross-country ski boot according to claim 4, wherein the fastening of said inner section (17) to said upper (10) extends substantially to the level of the upper end of the arch.

9. Cross-country ski boot according to any one of claims 1 to 3, wherein said boot comprises a reinforcing piece (11, 12) extending over the entire front part of the foot and wherein the covering upper comprises two half appliques (14, 15) sewn along said reinforcement piece and fitted with a closure system (16).

10. Cross-country ski boot according to claim 4, wherein each of said inner and outer sections (17, 18) is fitted internally with a lining (23) extending up to a mounting connection of said upper (10) of the sole (13) of the boot.

11. Cross-country ski boot according to claim 4, where the fastening of said inner section (17) to said upper section (10) extends above the upper end of the arch.

* * * * *